US005846171A

United States Patent [19]

Hollowell

[11] Patent Number: 5,846,171

[45] Date of Patent: Dec. 8, 1998

[54] COMPETITIVE BALANCE EXERCISE GAME DEVICE AND METHOD OF PLAY

[76] Inventor: Roger R. Hollowell, P.O. Box 258, Aspen, Colo. 81612-0258

[21] Appl. No.: 863,215

[22] Filed: May 27, 1997

Related U.S. Application Data

[60] Provisional application No. 60/019,235 Jun. 4, 1996.

[51] Int. Cl.[6] ..... A63B 21/02

[52] U.S. Cl. ..... 482/148; 482/51; 482/109

[58] Field of Search ..... 482/12, 109, 110, 482/905, 906, 122, 91; 472/137

[56] References Cited

U.S. PATENT DOCUMENTS

| | | | |
|---|---|---|---|
| 2,479,956 | 8/1949 | Nash | 273/1 |
| 2,937,023 | 5/1960 | Seymour et al. | 272/80 |
| 2,998,974 | 9/1961 | Stafford | 482/12 |
| 3,104,877 | 9/1963 | Gross | 273/95 |
| 3,129,940 | 4/1964 | Lauro | 272/79 |
| 3,323,796 | 6/1967 | Carlson | 273/1 |
| 4,039,185 | 8/1977 | Rhodes | 273/1 R |
| 4,153,245 | 5/1979 | McCoy | 273/1 R |
| 4,211,402 | 7/1980 | Carroll | 272/93 |
| 4,852,873 | 8/1989 | O'Donnell et al. | 482/122 |
| 4,856,776 | 8/1989 | Ching-Liang | 482/122 |
| 5,004,226 | 4/1991 | Brown, Jr. | 272/93 |
| 5,009,414 | 4/1991 | Bass | 272/76 |
| 5,230,679 | 7/1993 | Olsen | 482/91 |
| 5,284,459 | 2/1994 | Podd, III | 482/51 |
| 5,295,926 | 3/1994 | Tanable | 482/12 |
| 5,474,511 | 12/1995 | Dantolan | 482/110 |

*Primary Examiner*—Stephen R. Crow

*Attorney, Agent, or Firm*—John K. Flanagan; John R. Flanagan; Flanagan & Flanagan

[57] ABSTRACT

In a competitive balance exercise game played by two participants an elongated game device is employed in the form of an elongated rod having a pair of opposite end portions and a middle portion disposed between and integrally connected with the opposite end portions, and a pair of gripping sleeves each disposed over and attached to one of the opposite end portions of the rod. The material of the rod can vary from being relatively inflexible or stiff to semi-rigid and semi-flexible so that it will bend during play of the game. Each gripping sleeve is long enough to receive both hands of the participant and is comprised of a substantially rubber material. In playing the competitive balance exercise game, the two participants stand in a desired spaced positional relationship to one another at the start of the game, place the rod between them, grip the respective opposite ends of the rod with both hands, and move their toward and away from their bodies at the front and sides thereof until a loss of balance is experienced by a first one of the two participants. Also, the game may utilize at least one and preferably a pair of flat mats. Each flat mat is for one participant to stand on while playing the game. An alarm device may be mounted to the mat to detect when the participant standing thereof lifts a foot off the mat.

7 Claims, 4 Drawing Sheets

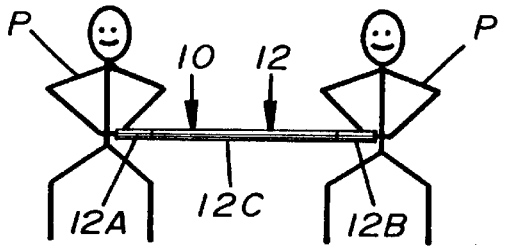
FIG. 9
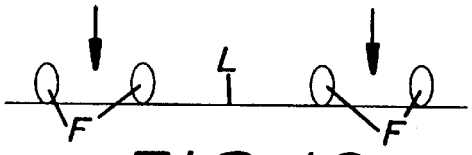
FIG. 10
FIG. 11
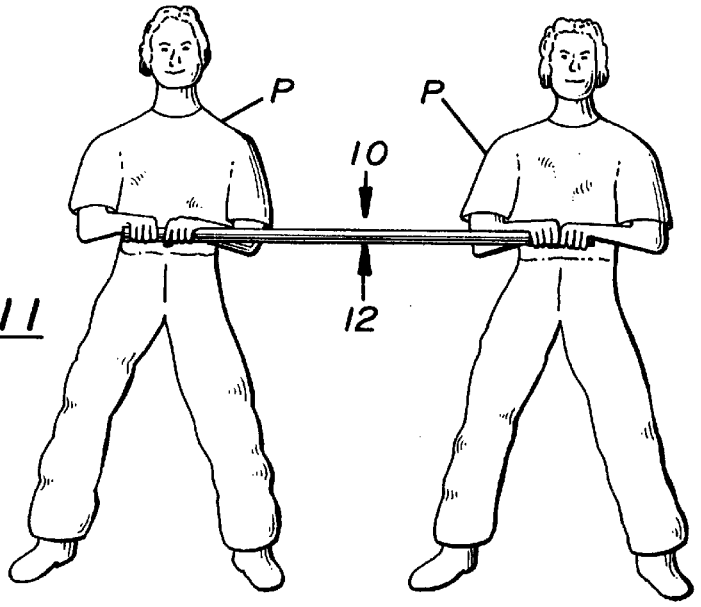
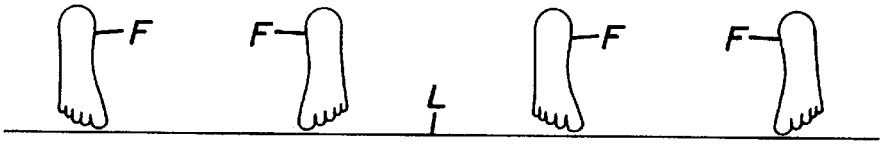
FIG. 12

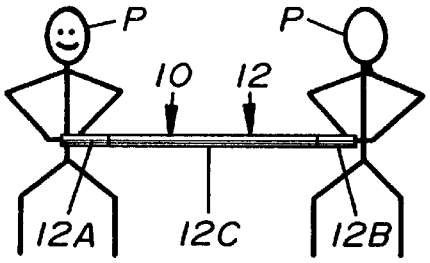
FIG. 13
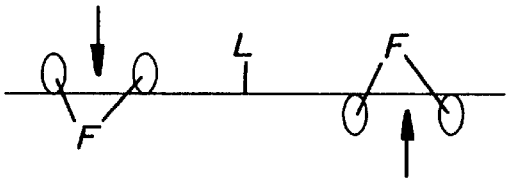
FIG. 14
FIG. 15
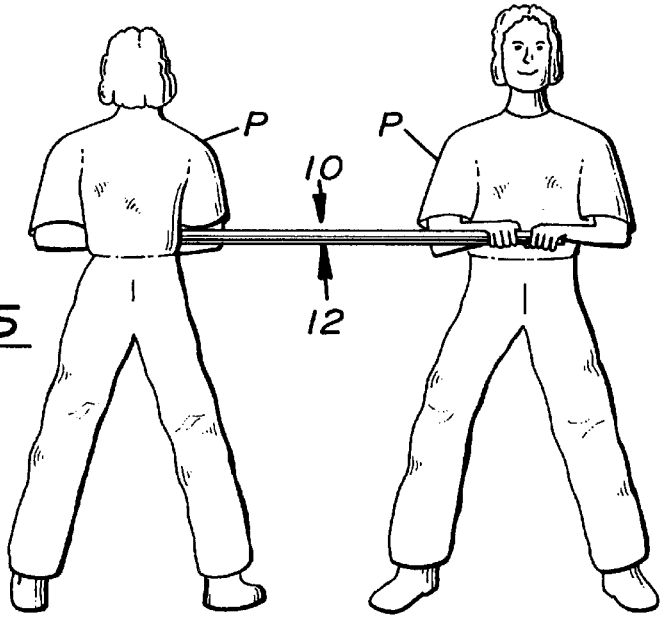
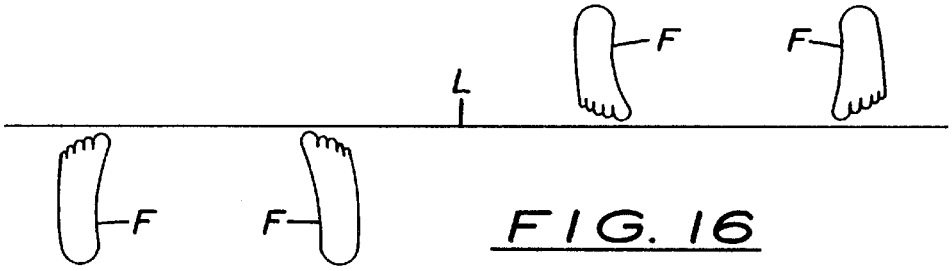
FIG. 16

COMPETITIVE BALANCE EXERCISE GAME DEVICE AND METHOD OF PLAY

This application claims the benefit of U.S. provisional application Ser. No. 60/019,235, filed Jun. 4, 1996. Also reference is hereby made to Disclosure Document No. 372,560, filed Mar. 20, 1995.

BACKGROUND OF THE INVENTION

1. Field of the Invention

The present invention generally relates to games for exercising the body and, more particularly, is concerned with a competitive balance exercise game device and method of play.

2. Description of the Prior Art

Exercise is an important part of daily life. It is an integral part of being healthy. Exercising the body, however, is an activity which many people do not enjoy. Individuals often need to be enticed into participating in exercise. Activities which are recreational in nature tend to be the forms of exercise which attract the most participants. Children, especially, enjoy playing games. It is often necessary to make exercise a game or a form of competitive recreation in order to draw participation.

Various competitive exercise games have been developed over the years. Representative examples of these exercise games and the like are disclosed in U.S. Pat. No. 2,479,956 to Nash, U.S. Pat. No. 2,937,023 to Seymour et al., U.S. Pat. No. 3,104,877 to Gross, U.S. Pat. No. 3,129,940 to Lauro, U.S. Pat. No. 3,323,796 to Carlson, U.S. Pat. No. 4,039,185 to Rhodes, U.S. Pat. No. 4,153,245 to McCoy, U.S. Pat. No. 4,211,402 to Carroll, U.S. Pat. No. 5,004,226 to Brown, Jr., U.S. Pat. No. 5,009,414 to Bass and U.S. Pat. No. 5,284,459 to Podd, III. While many of these prior art games provide devices that appear to be satisfactory in use for the specific purposes for which they were designed, none of them seem to provide an optimum approach to exercising balance in a competition between two participants.

Consequently, a need still exists for a game and device which provides an optimum approach for an individual to exercise his or her balance capabilities in a healthy competition with another individual.

SUMMARY OF THE INVENTION

The present invention provides a competitive balance exercise game and device therefor designed to satisfy the aforementioned need. The competitive balance exercise game and device of the present invention are designed for use by two participants. The game device is an elongated staff or rod having a desired predetermined degree of bendability and a pair of double hand grips one on each of the opposite ends of the elongated rod. In the game, the participants space themselves apart from one another by approximately the length of a middle portion of the elongated rod extending between the respective double hand grips on the opposite ends of the elongated rod. The participants can assume one of three basic standing positions: (1) facing each other; (2) side by side facing the same direction; or (3) side by side facing in opposite directions. The object of the game is for each participant to attempt to knock the other off balance by pushing and pulling on the elongated rod and thrusting the elongated rod from side to side until one of the participants lifts a foot or removes a hand from the elongated rod.

Accordingly, the present invention is directed to a competitive balance exercise game device which comprises: (a) an elongated rod having opposite end portions and a middle portion extending between and preferably being integral with the opposite end portions; and (b) a pair of bodies of gripping material each being disposed over and attached to one of the opposite end portions of the elongated rod. The elongated rod is generally comprised of a selected material which can vary from relatively inflexible or stiff to semi-rigid and semi-flexible so that it will be capable of bending a predetermined degree during play of the game. The pair of bodies of gripping material are preferably a pair of gripping sleeves. Each gripping sleeve is disposed over and attached to one of the opposite end portions of the elongated rod. Each gripping sleeve preferably is long enough to receive both hands of the participant. Each body or gripping sleeve is comprised preferably of a substantially rubber material.

The game device may also comprise an elongated tube made of a substantially resilient compressible foam-like material inserted over and covering the middle portion of the elongated rod. The game device may further comprise a pair of cup-shaped hilts. Each hilt is generally bowed toward one of the opposite end portions of the elongated rod and is disposed over and attached to the elongated rod where the middle portion of the elongated rod meets the one opposite end portion of the elongated rod. The game may also comprise at least one flat mat and preferably a pair of flat mats. Each flat mat is for one participant to stand upon while playing the game.

The present invention is also directed to a method of playing a competitive balance exercise game which comprises the steps of: (a) standing two participants in a desired spaced positional relationship to one another at the start of the game; (b) placing the elongated rod so that it extends between the two participants; (c) gripping one and the other of a pair of opposite ends of the elongated rod respectively with both hands of one and the other of the two participants; and (d) moving the hands of each of the two participants toward and away from their bodies until a loss of balance is experienced by a first one of the two participants.

Three basic standing positional relationships from which the desired one can be selected for use by the participants at the start of the game are as follows. The participants may stand facing one another at the opposite ends of the elongated rod and grip the opposite end portions of the elongated rod. In this position, each participant has the palms of his or her hands facing up. Each participant further has the same hand, either left or right, forward as the other participant. The participants may also stand side by side facing in the same or in opposite directions at opposite ends of the elongated rod and grip the opposite end portions of the elongated rod. In these positions, each participant has the palms of his or her hands facing down.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 9 is a side diagrammatic view of the game showing the participants side by side and facing the same direction and and gripping the elongated rod with their palms down.

FIG. 10 is a top diagrammatic view of the game showing the foot positions of the participants shown in FIG. 9.

FIG. 11 is a pictorial view of the two participants in the positions shown in FIG. 9.

FIG. 12 is a pictorial view of the feet of the two participants in the positions shown in FIG. 11.

FIG. 13 is a side schematic view of the game showing the participants side by side and facing in opposite directions and gripping the elongated rod with their palms down.

FIG. 14 is a top diagrammatic view of the game showing the foot positions of the participants shown in FIG. 13.

FIG. 15 is a pictorial view of the two participants in the positions shown in FIG. 13.

FIG. 16 is a pictorial view of the feet of the two participants in the positions shown in FIG. 15.

DETAILED DESCRIPTION OF THE INVENTION

Figure 1:
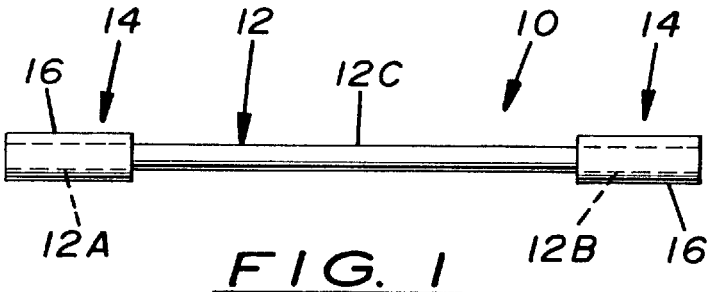
FIG. 1 is a top plan view of one embodiment of a device of the present invention used in a competitive balance exercise game of the present invention.
Figure 3:
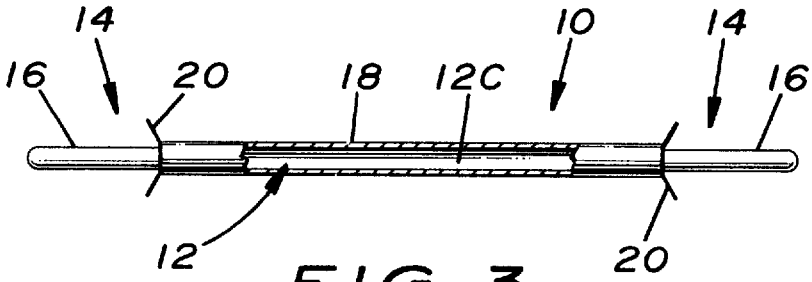
FIG. 3 is a top plan view of another embodiment of the device of the present invention.
Figure 4:
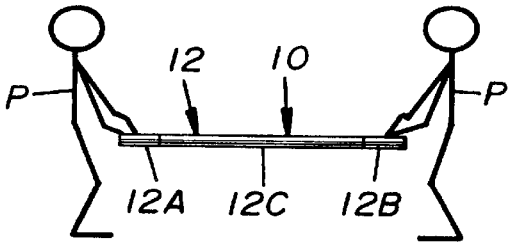
FIG. 4 is a side diagrammatic view of the game showing a pair of participants face to face and gripping the elongated rod with their palms up.
Figure 5:
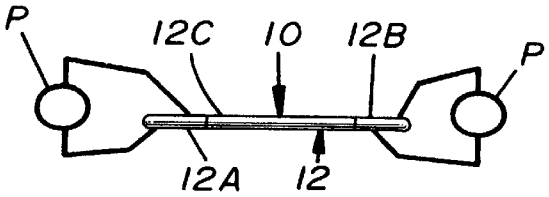
FIG. 5 is a top diagrammatic view of the game showing the participants gripping the elongated rod with their left hands forward.
Figure 6:
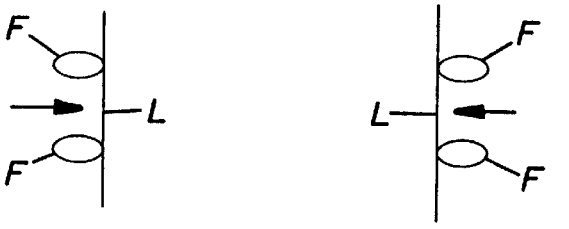
FIG. 6 is a top diagrammatic view of the game showing the foot positions of the participants shown in FIGS. 4 and 5.
Figure 7:
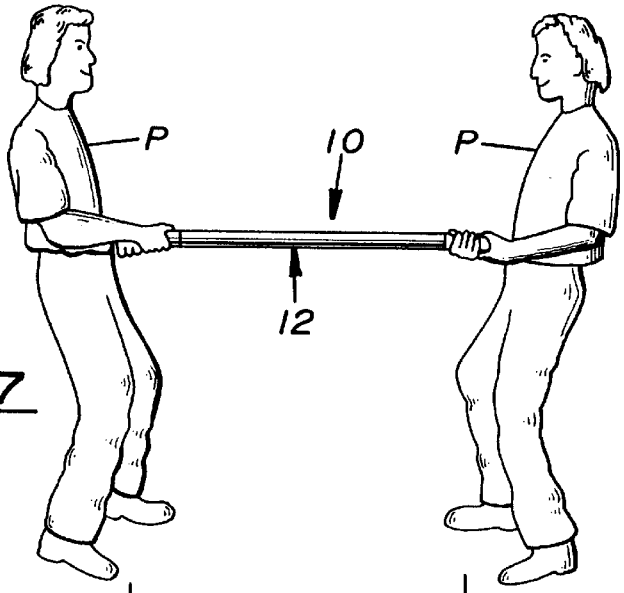
FIG. 7 is a pictorial view of the two participants in the positions depicted in FIG. 4 except with their right hands forward.
Figure 8:
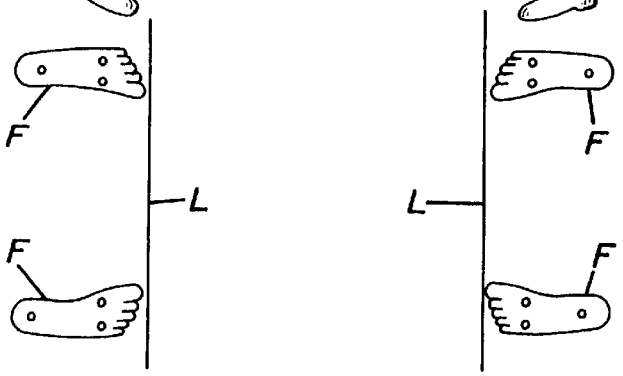
FIG. 8 is a pictorial view of the feet of the two participants in the positions shown in FIG. 7.

Referring to the drawings and particularly to FIGS. 1 and 3, there is illustrated a competitive balance exercise game device, generally designated 10, of the present invention. The device 10 basically includes an elongated rod 12 having opposite end portions 12A, 12B and a middle portion 12C being disposed between and integral with the opposite end portions 12A, 12B thereof, and a pair of bodies 14 of gripping material each being disposed over and attached to one of the opposite end portions 12A, 12B of the elongated rod 12. The game 10 is for use between two participants P. The participants P space themselves apart from one another at the opposite end portions 12A, 12B of the elongated rod 12.

The participants P can stand facing each other as seen in FIGS. 4 to 8, side by side facing the same direction as seen in FIGS. 9 to 12, or side by side facing in opposite directions as seen in FIGS. 13 to 16. The arrows in FIGS. 6, 10 and 14 point in the directions the participants P are facing. The object of the game 10 is for each participant P to attempt to knock the other off balance by pushing and pulling on the elongated rod 12 and thrusting the elongated rod 12 from side to side until one of the participants P lifts a foot or removes a hand from the rod.

Referring now to FIG. 1, the elongated rod 12 is generally comprised of a material which can vary from being relatively inflexible or stiff to semi-rigid and semi-flexible so that it will bend during play of the game 10. The material from which the elongated rod 12 is made can be selected so as to give it a desired degree of flexibility or bendability and spring-back. The specific material used would also depend upon how aggressive the participants wish to play. The lesser the degree of flexibility and spring-back of the material the more aggressive the play can be. On the other hand, the greater the degree of flexibility and spring-back of the material the less aggressive the play can be. An assortment of elongated rods 12 of varying degrees of flexibility can be provided for this purpose generally from a selection of different materials of metal, wood, plastic, fiberglass, PCV, bamboo and like. For instance, a selection of aluminum would make the elongated rod 12 substantially stiff. Preferably, the elongated rod 12 can yieldably and resiliently bend through an arc of up to 30° away from the normal straight condition of the elongated rod 12. A bendable elongated rod 12 would generally permit an optimum level of competition between participants having average balancing skills, as compared to a stiff elongated rod 12. Furthermore, the diameters of the elongated rods 12 can vary from ¾ inch to 1-¼ inch, while their lengths can vary from 3 feet to 5 feet. However, an elongated rod 12 of approximately 1 inch in diameter and 4 feet in length is most suitable, if not optimal, for use in the game. Also, the middle portion 12C of the elongated rod 12 is substantially greater in length than each of the opposite end portions 12A, 12B of the elongated rod 12.

The pair of bodies 14 of gripping material are preferably a pair of gripping sleeves 16. Each gripping sleeve 16 is disposed over and attached to one of the opposite end portions 12A, 12B of the elongated rod 12. Each gripping sleeve 16 preferably is long enough to receive both hands of the participant. Each body 14 or each gripping sleeve 16 is comprised of a substantially rubber material, but can be made of any other suitable material. In face to face competition, the elongated rod 12 should be grasped with palms up and each participant should have the same hand forward as the other. In side-by-side competition, the elongated rod 12 should be grasped with palms down.

Figure 2:
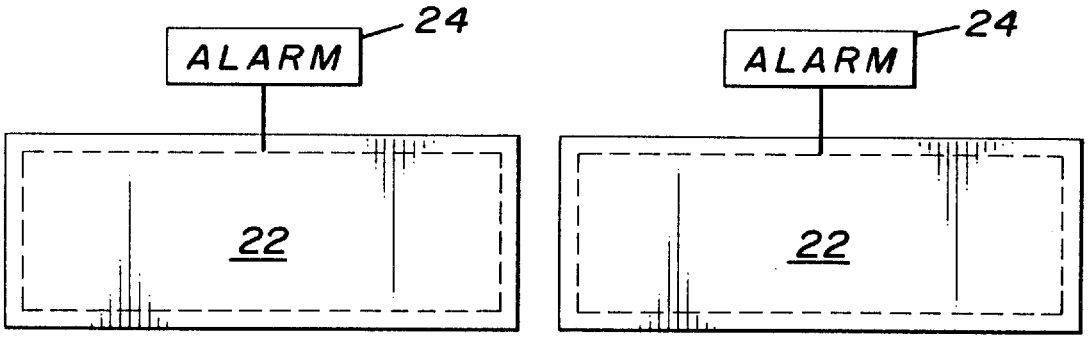
FIG. 2 is a top plan view of a pair of flat mats upon which the two participants of the game can stand while playing the game.

Referring to FIG. 2, the game 10 may further comprise at least one flat mat 22 and preferably a pair of the mats 22. Each mat 22 is for one participant to stand upon while playing the game 10. Each mat 22 provides a surface which helps to prevent any unforced slippage of the feet of the participant standing thereon. Each mat 22 is comprised of any suitable material to achieve this effect. Each mat 22 may also demarcate the area of play. In other words, a participant loses if he or she steps in any direction beyond the periphery of the mat 22 upon which he or she is standing at the start of the game 10. Also, an alarm 24 can be coupled to the mat 22, by employment of any conventional electrical, mechanical or pneumatic means well-known to those of ordinary skill in the art, to respond to pressure on the mat 22 to accurately detect and indicate when a combatant has lifted a foot from the mat 12. A similar arrangement can be connected to each of the gripping sleeves 16 of the rod 12 in order to detect removal of a hand therefrom.

Referring now to FIG. 3, there is shown another embodiment of the game device 10 having a modified configuration in comparison to the embodiment which is shown in FIG. 1. The game device 10 may comprise an elongated tube 18 made of a substantially resilient compressible foam-like material inserted over and covering the middle portion 12C of the elongated rod 12. The game 10 may also comprise a pair of cup-shaped hilts 20. Each hilt 20 is generally bowed toward one of the opposite end portions 12A, 12B of the elongated rod 12 and is disposed over and attached to the elongated rod 12 where the middle portion 12C of the elongated rod 12 meets the one opposite end portion 12A, 12B of the elongated rod 12. Each hilt 20 prevents one of the participants from moving a hand onto the middle portion 12C from the one opposite end portion 12A, 12B of the elongated rod 12. Each hilt 20 is comprised of any suitable material.

Referring now to FIGS. 4 to 16, there is shown the three basic positions for each of the participants P at the start of the game employing the device 10. As seen in FIGS. 4 to 8, the participants P stand facing one another at the opposite ends of the elongated rod 12 and grip the opposite end portions 12A, 12B of the elongated rod 12. Each participant P has his or her hands positioned such that each palm is facing up. Each participant P further has the same hand, either left or right, forward as the other participant P.

As seen in FIGS. 9 to 12, the participants P stand side-by-side facing in the same direction at opposite ends of the elongated rod 12 and grip the opposite end portions 12A, 12B of the elongated rod. Each participant P has his or her hands positioned such that each palm is facing down.

As seen in FIGS. 13 to 16, the participants P stand side by side but facing in opposite directions at opposite ends of the elongated rod 12 and grip the opposite end portions 12A, 12B of the elongated rod. Each participant P has his or her hands positioned such that each palm is facing down, as in the basic position shown in FIGS. 7 and 8.

Furthermore, in their respective stances, each of the participants P stand with their feet F slightly wider apart than the widths of their shoulders. Their knees should be bent. Their pelvises should be pushed forward. Their stomachs should be flat. Opponents should always stand an elongated rod 12 length apart from each other measured from their belly buttons. Their feet F should always be parallel with each pair toeing a common line L in face to face competition. The feet F of both participants P should toe the same line L in side by side competition.

The object of the game is to "knock" one's opponent off balance so that he or she either has to lift a foot or remove a hand from the rod. Each combatant tries to "knock" the other combatant off balance by pushing and pulling on the rod and thrusting the rod from side to side until one combatant lifts a foot or removes a hand from the rod. Thus, the object of the game is to cause one's opponent to lose balance to the point where he or she has to take a single step or steps beyond the periphery of a flat mat 22 or lets go of the elongated rod 12. Once play begins, the participants P cannot let go of the elongated rod 12 or move their feet F. The participants P are generally free to move in any way they wish but a lifted foot or free hand signals the end of the match with the loser being the one who either lifted a foot or let go first.

Playing the competitive balance exercise game described above improves each participant's sense of balance. Proficiency at playing the game is gained by the participant being able to feel the triangulation relationship existing between his or her feet and the ground and to sense the outer circle within which the center of the participant's body can move while remaining stable. The triangulation points are represented by the three circles drawn on the feet shown in FIG. 8. The body's center is located just below the navel. The participant learns to rotate his or her body while still keeping the three major points of connection of each foot with the ground intact. The participant can readily feel and thereby understand how one's balance is compromised when one of the foot connections becomes weak and what are the limits in how far the participant can move his or her body center while keeping the foot connections intact. This limit can be increases or expanded by lowering the center (bending at the knees).

While a one-piece device 10 is shown in the drawings, it is within the purview of the present invention to provide the device in separable parts which can be assembled and disassembled for ease of storage, packaging and sale.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A competitive balance exercise game device, comprising:

(a) an elongated rod having opposite end portions, a middle portion disposed between and attached with said opposite end portions, a diameter falling within a range of from about ¾ inch to about 1-¼ inch and a length falling within a range of from about 3 feet to about 5 feet, said elongated rod normally being in a substantially straight condition and possessing a predetermined degree of flexible bendability from and resilient spring-back to said straight condition and being bendable in any direction through an arc of up to about 30 degrees away from said straight condition;

(b) a pair of bodies of gripping material, each of said bodies of gripping material disposed over and attached to one of said opposite end portions of said elongated rod, each of said bodies of gripping material having a sufficient length to receive both hands of a participant; and a pair of cup-shaped hilts each bowed toward one of said opposite end portions of said elongated rod and disposed over and attached to said elongated rod where said middle portion of said elongated rod meets said one opposite end portion of said elongated rod.

2. The device of claim 1 wherein said middle portion of said elongated rod is substantially greater in length than each of said opposite end portions of said elongated rod.

3. The device of claim 1 wherein said elongated rod has a diameter of about 1 inch and a length of about 4 feet.

4. The device of claim 1 further comprising:

an elongated tube comprised of a substantially resilient compressible material inserted over and covering said middle portion of said elongated rod.

5. A competitive balance exercise game device, comprising:

(a) an elongated rod having opposite end portions and a middle portion disposed between and integral with said opposite end portions thereof, said middle portion of said elongated rod being substantially greater in length than each of said opposite end portions thereof, said elongated rod having a diameter falling within a range of from about ¾ inch to about 1-¼ inch and a length falling within a range of from about 3 feet to about 5 feet, each of said opposite end portions having a sufficient length to receive both hands of a participant, said elongated rod normally being in a substantially straight condition and possessing a predetermined degree of flexible bendability from and resilient spring-back to said straight condition and being bendable in any direction through an arc of up to about 30 degrees away from said straight condition;

(b) a pair of gripping sleeves each disposed over and attached to one of said opposite end portions of said elongated rod; and a pair of cup-shaped hilts each bowed toward one of said opposite end portions of said elongated rod and disposed over and attached to said elongated rod where said middle portion of said elongated rod meets said one opposite end portion of said elongated rod.

6. The device of claim 5 further comprising:

an elongated tube comprised of a substantially resilient compressible material inserted over and covering said middle portion of said elongated rod.

7. The device of claim 5 wherein each of said gripping sleeves is comprised of a substantially rubber material.

* * * * *